United States Patent [19]

Lee

[11] Patent Number: 4,601,921

[45] Date of Patent: Jul. 22, 1986

[54] METHOD AND APPARATUS FOR SPRAYING COATING MATERIAL

[75] Inventor: Hsai-Yin Lee, Troy, Mich.

[73] Assignee: General Motors Corporation, Detroit, Mich.

[21] Appl. No.: 686,081

[22] Filed: Dec. 24, 1984

[51] Int. Cl.[4] ..... B05D 3/12

[52] U.S. Cl. ..... 427/240; 118/300; 118/624; 118/626; 239/293; 239/300; 427/31; 427/421

[58] Field of Search ..... 427/240, 421, 31; 118/624, 626, 300; 239/223, 224, 290, 293, 300, 301

[56] References Cited

U.S. PATENT DOCUMENTS

| | | | |
|---|---|---|---|
| 2,177,851 | 10/1939 | Wallace | 239/293 |
| 2,304,857 | 12/1942 | Stahl | 239/300 |
| 2,743,963 | 5/1956 | Peeps | 239/300 |
| 3,251,551 | 5/1966 | Walberg | 118/626 |
| 3,342,418 | 9/1967 | Wallis | 239/296 |
| 3,346,412 | 10/1967 | Siegenthaler et al. | 118/626 |

FOREIGN PATENT DOCUMENTS

| | | |
|---|---|---|
| 653612 | 3/1929 | France . |
| 864877 | 4/1961 | United Kingdom . |
| 1154014 | 6/1969 | United Kingdom . |

*Primary Examiner*—John D. Smith
*Assistant Examiner*—Janyce A. Bell
*Attorney, Agent, or Firm*—Warren D. Hill

[57] ABSTRACT

A conical sheath of air emitted from a vortex plenum adjacent the outer edge of a rotating bell spray apparatus is effective to optionally help atomize the coating material, and to carry the atomized material forwardly toward a confluence on the axis of the rotating head where tubulent mixing of the particles occurs, and the particles are sprayed forwardly for deposition in a uniform thickness film of a uniform population mix of particles sizes. Forward air and tangential air components are admitted to the plenum and are independently controlled so that different spray characteristics are obtained, the tangential air providing a swirl moment to the conical air sheath which enlarges the size of the deposited film pattern. The forward velocity determines the atomization ability of the sheath air and the particle velocity in the spray pattern. Electrostatic and non-electrostatic operations are intended.

14 Claims, 9 Drawing Figures

METHOD AND APPARATUS FOR SPRAYING COATING MATERIAL

This invention relates to a method and apparatus for spraying liquid coating material such as paint and particularly to such a method and apparatus using centrifugal force to disperse the coating material coupled with a conical sheath of air to control the spray pattern.

Variations in the requirements for spraying liquid coating material such as paint has resulted in many specialized methods or spray devices. In the automotive industry alone, vehicle painting techniques include various types of air spray guns with or without electrostatic deposition fields between the atomizer and the workpiece, and electrostatic rotary bells. The electrostatic fields are used to aid in atomization or to enhance the deposition efficieny; on the other hand, in the case of metallic paints, the electrostatic deposition causes a characteristic appearance which is not always desirable. Other variations in the application of coating material are that of vehicle or workpiece being painted may be either stationary or moving along a conveyor line or the paint applicator itself may be stationary or move relative to the workpiece under the control of a reciprocator or a robot. The equipment selected for a particular application then is chosen with a view toward its particular abilities and limitations, and its suitability for the specific job.

The rotary bell has become a highly developed and very useful spray apparatus partly because of its ability to effectively atomize high solids content coating material or other material which is difficult to atomize. The rotary bell also makes effective use of electrostatic deposition since the overspray attendant to conventional air atomization is absent. Even in the case of the rotary bell, however, some forwardly directed shaping air emitted from ports to the rear of the atomizing head is used to help direct the spray pattern toward the workpiece, that is, to overcome the centrifugal dispersion forces on the paint. An undesirable characteristic of the rotary bell with an electrostatic deposition field is that the spray pattern deposits paint on the workpiece in the form of an annulus or doughnut. A cross section through such a deposited annular film is shown in FIG. 1 where the paint thickness is shown as a function of the distance across the diameter of the deposition pattern. A number of schemes have been proposed to overcome the drawbacks of this characteristic such as the use of multiple bells with overlapping patterns, specially shaped electrostatic fields to induce a more desirable pattern, and most commonly, the attempt to fill in the center of the doughnut with a judicious usage of the shaping air. That is, while the shaping air primarily forms an envelope for the spray pattern and does not admix with the atomized particles, it may have a velocity component toward the axis of the pattern to urge some of the particles toward the center of the pattern, thereby forming a solid circular film as depicted in cross section in FIG. 2. Even then, however, the film thickness is not uniform but is still generally thinner at the center of the pattern than it is in the annular deposition area. Another problem with filling the annular pattern with the influence of the shaping air is that those particles which are most easily influenced to move toward the center are those with the smallest mass, that is, the small particles, with the result that the annular deposition area of the paint film is populated principally by large paint particles and the center of the pattern is populated by small paint particles, thereby giving rise to two different coating qualities in the same deposition pattern, neither having the benefit of a blend of large and small particles. The ideal paint deposition pattern as shown in cross section in FIG. 3 is of uniform thickness except that the edges are tapered off for easy blending with the adjacent patterns. The ideal pattern is also comprised of a uniform particle size distribution thoughout the area of the pattern. It is also desirable to control the size of the pattern for a given application or even to be able to change the pattern size at will. Even though electrostatic deposition with a rotary spray head gives desirable benefits, it is desirable at times to operate without an electrostatic field, for example, to apply metallic coating materials. However, conventional rotary bells require electrostatic deposition fields. Finally, while the very high speeds of a rotary bell are effective for atomization of certain types of materials, a few months of high speed operation results in bearing deterioration which requires replacement of the apparatus or extensive rebuilding thereof; in contrast, when operated at low or moderate rotary speeds, extended bearing lifetime is achieved.

It is therefore, an object of this invention to provide a method and apparatus for spraying liquid coating material from a rotary atomizing head and depositing it on a workpiece in a uniform film having a uniform particle size mix.

It is a further object of the invention to provide such a method and apparatus with the ability to control the size of the deposition pattern.

It is another object of the invention to provide a method and apparatus using a rotary spray head with or without air atomization to optionally allow lower rotary head speeds.

It is still another object of the invention to provide such a method and apparatus useful with or without electrostatic deposition.

The method of the invention is carried out by centrifugally dispersing coating material into the air in an annular pattern about an axis and directing a conical sheath of air forwardly through the pattern and toward a confluence on the axis with sufficent velocity to effect turbulent mixing of particles of the coating material, so that the coating material is atomized and deposited on the workpiece in a film of substantially uniform thickness.

The method of the invention also embraces imparting a swirl component to the sheath of air to cause enlargement of the spray pattern which emerges from the confluence.

The apparatus according to the invention is carried out by a rotary spray head having a forward rim for centrifugal dispersion of coating material and a vortex plenum surrounding the head provided with an annular discharge slit for projecting a conical sheath of air around the rim to direct the coating material forwardly and inwardly, and controls for the plenum airflow including an air input for air moving in a forward flow direction and another air input for tangential airflow to impart a swirl moment to the sheath of air.

The apparatus according to the invention also embraces a vortex plenum shaped near its discharge slit with walls angularly disposed to project the conical sheath of air forwardly toward a confluence on the axis.

In referring to the direction of the airflow from the plenum the term "forward" is used to mean the direction generally toward the workpiece but having a component toward the axis of the rotary head so that the sheath is directed toward a confluence on the axis. Thus the shape of the air sheath in the region of the discharge slit and the rim of the rotary head is conical. As the air from various circumferential portions of the sheath converges it departs from a cone shape and comes together at a "confluence" generally centered on the axis and forward of the geometric apex of the cone.

The above and other advantages will become more apparent from the following description taken in conjunction with the accompanying drawings wherein.

Figure 1:
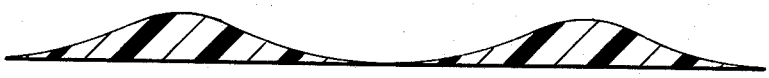
FIGS. 1 and 2 are diametrical cross sections of deposited paint film patterns produced according to the practices of the prior art.
Figure 2:
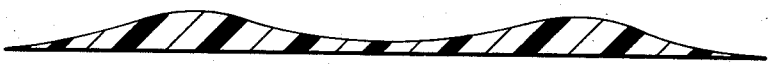
Figure 3:
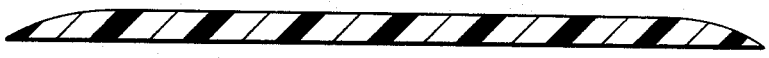
FIG. 3 is a diametrical cross section of an ideal paint film pattern which is a goal of the method and apparatus of the invention.
Figure 4:
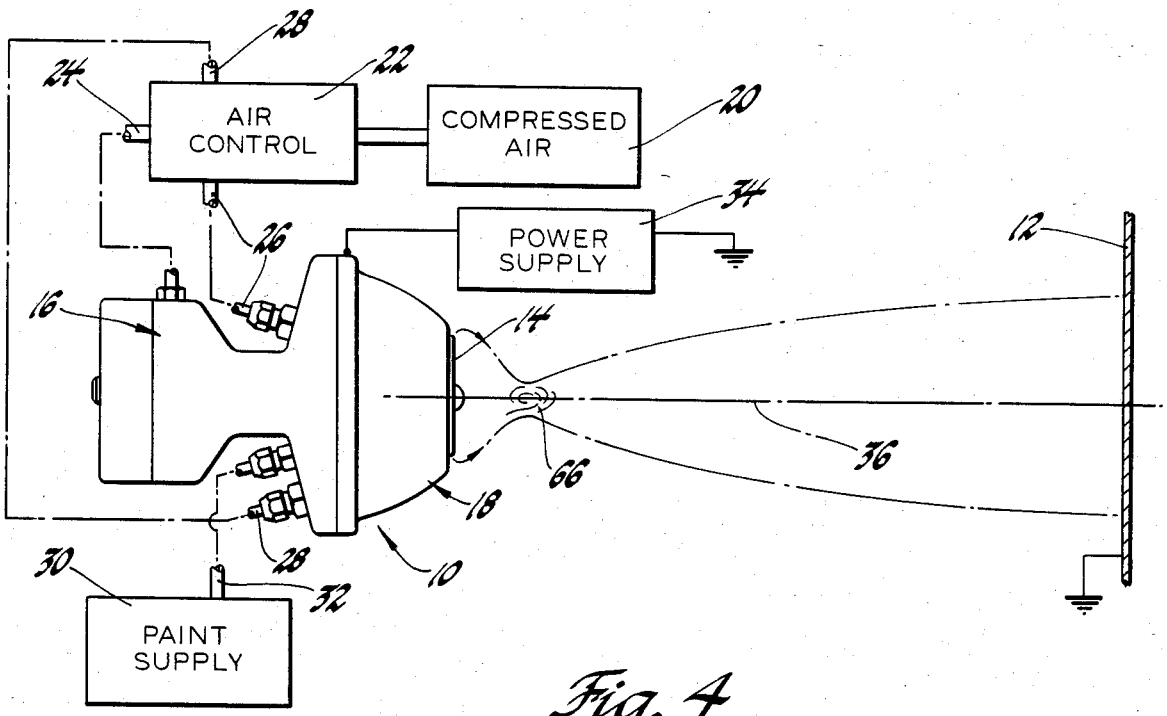
FIG. 4 is a schematic view of spray apparatus according to the invention illustrating one mode of operation.

Referring to FIG. 4 a paint spray apparatus 10 for applying paint to an electrically grounded workpiece 12 includes a conventional rotary paint spray bell 14 driven by an air turbine, not shown, enclosed in housing 16. Since such air turbine driven bells are commercially available and are well known in the art, no further description is necessary. An air vortex plenum 18 surrounding the bell 14 has its forward edge terminating just to the rear of the forward rim of the bell 14. The supporting system for the spray apparatus includes a compressed air supply 20 and an air control 22 which can be preset or programmed to supply the desired air pressure over line 24 for driving the air turbine at a desired speed, and also can variably control air over supply lines 26 and 28 to the vortex plenum 18. A paint supply 30 is coupled to the spray apparatus by paint line 32 and an electrostatic power supply 34 is coupled to the spray apparatus to optionally establish an electrostatic field between the apparatus and the workpiece 12.

Figure 5:
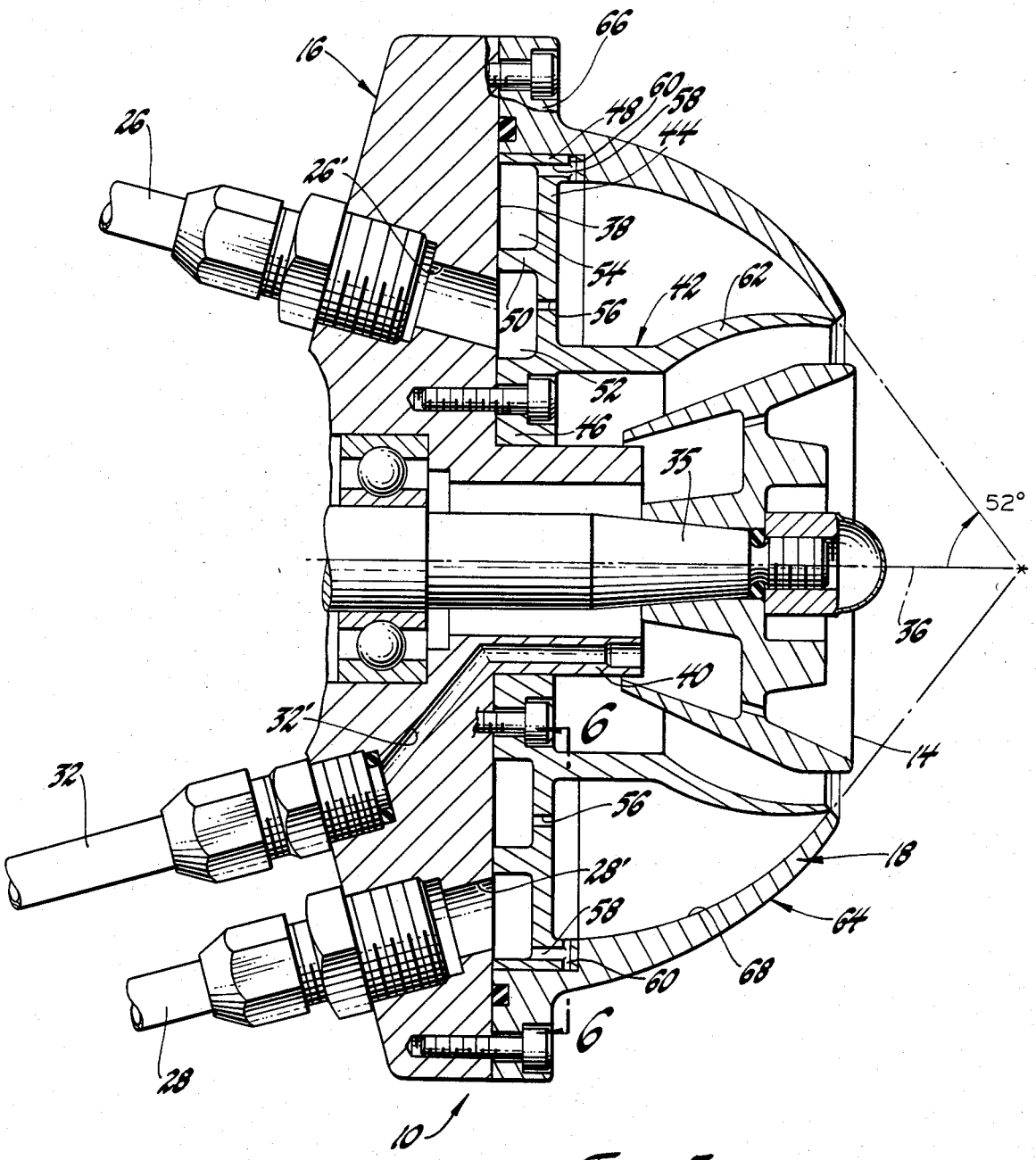
FIG. 5 is a detailed cross-sectional view of a portion of the apparatus of FIG. 4 illustrating the spray head and the vortex plenum according to the invention.
Figure 6:
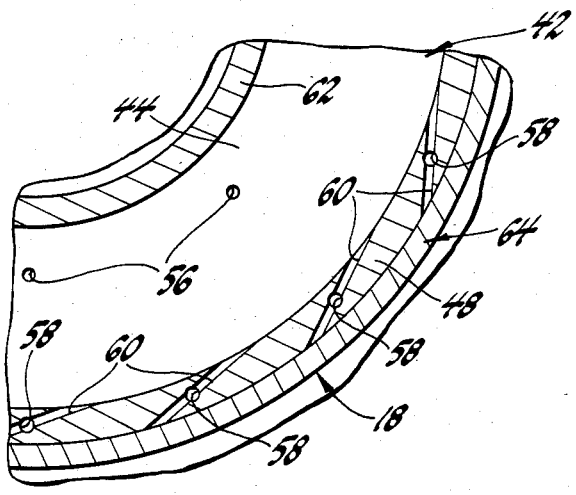
FIG. 6 is a partial cross-sectional view of the plenum taken along line 6—6 of FIG. 5.

Details of the vortex plenum 18 are shown in FIGS. 5 and 6. The plenum 18 is concentric with the bell 14 and the bell rotation axis 36. The housing 16 of the spray apparatus has a generally flat forward face 38 except for a central annular hub 40 which extends forwardly into the rear of the bell 14 and which contains a paint passage 32', coupled to the paint supply line 32 for furnishing paint to the inside of the bell 14. A plenum manifold 42 comprises a flat plate section 44 parallel to and spaced from the housing face 38 and has an inner rim 46 and an outer rim 48 and a central web 50 all of which engage the housing face 38 thereby defining two concentric annular air channels 52 and 54 between the plate 44 and the housing face 38. The channel 52 is coupled by a passage 26' in the housing to the air supply line 26 while the channel 54 is coupled by a passage 28' in the housing to the air supply line 28. A series of axially directed ports 56 extend through the plate 44 in communication with the passage 52. The outer rim 48 of the manifold 42 extends forwardly of the plate 44 and contains a plurality of axial passages 58 each coupled at one end to the passage 54 and coupled at the other end to transverse ports 60 which, as shown in FIG. 6, extend through the rim 48 at a very large angle (say, 70°) to the radial direction so that any air admitted through the ports 60 has a velocity nearly tangential to the inside wall of the rim 48. The inner rim 46 of the manifold 42 extends radially inwardly to locate against the hub 40, and it is secured to the housing 16 by threaded fasteners. A forwardly extending annular wall 62 integral with the manifold 42 extends axially from the plate 44 for a short distance and then curves smoothly outwardly and forwardly around the contour of the bell 14 to a terminus just to the rear of the forward rim of the bell 14. A plenum shroud 64 has an outer flange 66 seated against the housing face 38 and secured thereto. The inner circumference of the flange 66 engages the outer circumference of the manifold rim 48. The shroud 64 is smoothly curved from the flange 66 toward the forward terminus of the wall 62 so that the inner wall 68 of the shroud 64 makes a smooth transition from the inner surface of the rim 48 to a location only slightly spaced from the forward terminus of the wall 62 to define a narrow annular air discharge slit between the walls 62 and 68, which slit is slightly to the rear and radially outwardly of the rim of the bell 14. For a bell of 48 mm diameter, the discharge slit is preferably 58 mm in diameter, 0.1 mm wide, and is 2.5 mm to the rear of the front face of the bell. The surface slope of the forward portion of the wall 68 is such that if a tangent of the wall were extended toward the axis 36 it would make an angle of preferably 52° with that axis. While 52° is the calculated optimum angle, other angles of that same order of magnitude are probably effective. In prior art systems where axially directed jets of shaping air are used, a reverse flow eddy current occurs along the bell axis to carry some paint particles back to the bell to deposit on the bell. This invention provides an air confluence near the bell and prevents the formation of the eddy current to maintain a clean spray head.

An optional feature, not shown, also helpful in maintaining cleanliness of the spray head is an air passage connected to the air supply 20 and extending through the inner rim 46 to supply air to the space between the manifold 42 and the bell 14, thereby preventing the formation of a low pressure zone around the bell which could draw paint particles into that space.

Figure 7:
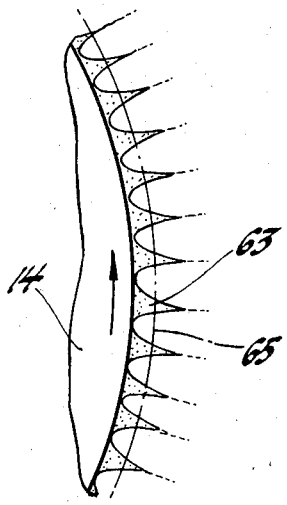
FIG. 7 is a partial view of a rotary spray head illustrating centrifugal dispersion of liquid therefrom.

FIG. 7 illustrates a portion of the bell 14 as seen from the rear illustrating how paint or other liquid coating material is dispersed from the edge thereof in a thin film 63 which is formed into regularly extended cusps distributed in an annular array around the edge of the bell. The film and the cusps are formed by the action of centrifugal force on the coating material. Ultimately the cusps form fine filaments which break into droplets thereby effecting the atomization of the coating material. This action is the result of centrifugal force, or in the event an electrical field is applied to the edge of the bell, the combination of centrifugal and electrostatic forces. When rotating bells are used in the conventional manner a gentle airflow is directed forwardly around the bell to assist the electrostatic forces in moving the particles forward toward the workpiece. According to the present invention the conical sheath of air discharged from the vortex plenum 18 moves in a path intersecting the paint film 63 at a circle indicated by the broken line 65. Typically, the filaments extend about 5 mm from the rim of the bell. The dimensions of the plenum and the sheath angle assure that the sheath intersects the film or filament about 2.5 mm from the rim. If sheath air movement is sufficiently forceful it will assist in the atomization process and less centrifugal force is needed. If the sheath air movement is not forceful enough to help atomize the paint film it would still be sufficient to move the filaments and particles forwardly toward the axis 36. In any event, according to this invention the air movement will be forceful enough to admix with atomized paint, and as illustrated in FIG. 4, carry the atomized paint to a confluence 66 on the axis 36 where turbulent mixing of the paint particles occurs and therefore carries the spray forwardly toward the workpiece 12. The effect of this air sheath then is to eliminate any tendency for the rotating bell to deposit a doughnut pattern on the workpiece as well as to avoid separation of particles sizes so that a uniform film comprised of a uniform mixture of particles sizes results.

The air sheath emitted from the vortex plenum is subject to a wide range of control. Air admitted to the plenum through the axially disposed ports 56 results in a conical air sheath emitted from the plenum discharge slit moving in the forward direction, that is, having velocity components toward the workpiece 12 and toward the axis 36 so that the air is directed toward the confluence 66. The pressure of the volume of air admitted through ports 56 is determined by the air control 22. Assuming no other air input, a high pressure setting produces a spray pattern as indicated in FIG. 4 where the sheath air has high velocity and correspondingly high atomization ability. A confluence 66 is near the bell 14 where turbulent mixing of the atomized particles takes place and the high forward velocity of the air projects atomized particles toward the workpiece 12. The atomization assist of the high velocity air allows the bell to be rotated at a slower speed to substantially increase the bearing life of the spray device. Another feature of using the high velocity forward air is that the high paint particle velocity allows the bell to be moved rapidly, as by a robot, across the surface of the workpiece 12; by contrast, only very slow movements of a conventional bell are practical.

Figure 8:
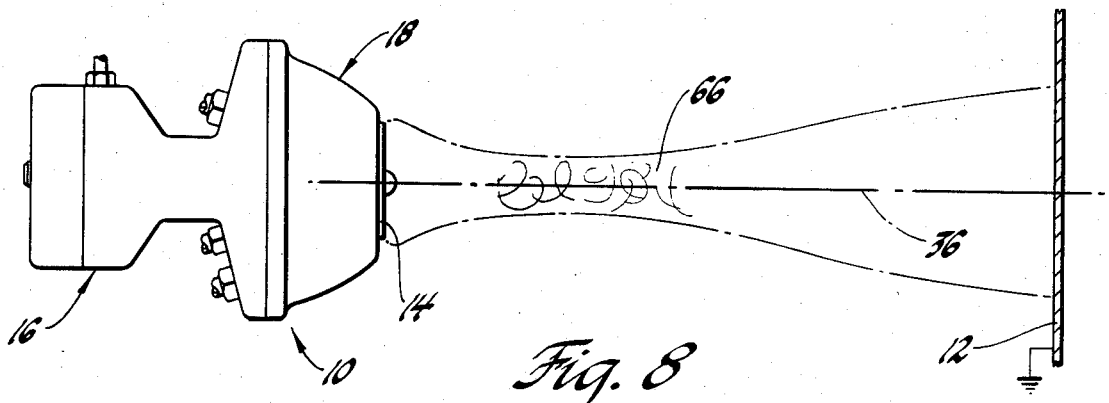
FIGS. 8 and 9 are schematic views of the apparatus of FIG. 4 operating in two additional modes according to the invention.

If a moderate air pressure is applied to the axis port 56 then the forward air flow is lower in velocity and may be insufficient to help atomize the coating material. In that case an electrostatic field is preferred and higher bell speeds are required. Still the forward air carries the atomized paint to a confluence 66 which is spaced further from the bell, as shown in FIG. 8, than occurs in the high air velocity example of FIG. 4. Turbulent mixing of the atomized particles occurs at the confluence and the forward air imparts some forward velocity to the particles moving toward the workpiece. This of course, will be a "softer" spray than that obtained by the use of high velocity forward air. This soft spray is effectively used with a stationary bell, that is, one which is not traversed across the workpiece surface. The diameter of the film deposited on the workpiece 12 is about the same for the high velocity and the moderate velocity forward air.

Figure 9:
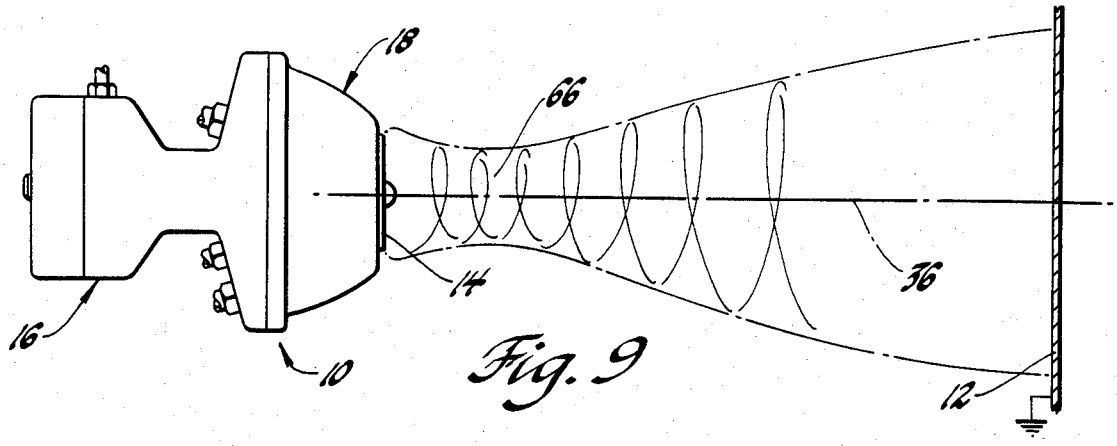

To control the size of the deposited film pattern a tangential component or a swirl moment is added to the sheath of air by applying air pressure to the supply lines 28 causing air to be emitted from the tangential ports 60. A rotational momentum is established in the plenum, which momentum is conserved throughout the spray pattern. If the tangential air through ports 60 is used with no forward air from the axial ports 56 then, as shown in FIG. 9, the spray pattern will be generally larger in diameter than that obtained when the forward air only is used. Due to the shape of the vortex plenum 18 the vortex air is emitted from the plenum in a conical sheath toward a confluence 66 on the axis 36 where tubulent mixing of the atomized particles takes place. Because of the centrifugal force in the swirling vortex, the entire spray pattern is larger in diameter so that the confluence itself is larger than in the cases of FIGS. 4 and 8, and the deposited film pattern on workpiece 12 will also be much larger. When only tangential air is used the air atomization of the coating material does not take place and the spray pattern will be a soft mist requiring an electrostatic field for efficient deposition.

In typical applications the tangential air would not be used along, rather the combination of forward air and tangential air will be used. Since both the tangential and the forward air is controllable over very wide ranges, the apparatus is very flexible and can be tailored in operation for use under many conditions. The velocity of the forward air is selected according to the requirements of paint atomization and paint particle velocity as offset againt the effectiveness of electrostatic deposition; the size of the paint deposition pattern is selected by imposing the appropriate amount of tangential air.

It will thus be seen that according to this invention a rotating bell type of spray apparatus can be used to obtain a film pattern of uniform thickness as well as a uniform mix of particles sizes throughout the deposited film pattern, that the spray apparatus can be used electrostatically and non-electrostatically, that its deposited film pattern can be varied in size, and the spray apparatus may be used in a stationary position or moved rapidly across a workpiece surface.

The embodiments of the invention in which an exclusive property or privilege is claimed are defined as follows:

1. A paint spray apparatus having a rotary head defining a forward rim for the centrifugal dispersion of paint, a vortex plenum surrounding the head and having an annular discharge slit to the rear of the rim for projecting a conical sheath of air around and adjacent the rim to direct the paint in a forward and inward direction, and means for controlling the air flow from the plenum including a first air input means for admitting air to impart a forward flow direction to the sheath of air and a second air input means for admitting air to impart a tangential flow direction to the sheath of air, whereby the sheath air velocity is controlled to determine the paint spray pattern from the head.

2. A paint spray apparatus having a rotary head defining an axis and a forward rim for the centrifugal dispersion of paint, a vortex plenum surrounding the head and having an annular discharge slit to the rear of the rim for projecting a conical sheath of air around and adjacent the rim to direct the paint in a forward and inward direction toward a confluence on the axis, and means for controlling the air flow from the plenum including a first air input means for admitting air to impart a forward flow direction to the sheath of air and a second air input means for admitting air to impart a tangential flow direction to the sheath of air, whereby the sheath air velocity is controlled to determine the paint spray pattern from the head.

3. A paint spray apparatus having a rotary head defining an axis and a forward rim for the centrifugal dispersion of paint in a circular pattern, air atomizing means comprising, a vortex plenum surrounding the head and having an annular discharge slit to the rear of the rim for projecting a conical sheath of air forwardly around and adjacent the rim to intersect the circular pattern of paint, the sheath of air having a sufficient velocity to atomize the paint into particles and having a velocity component toward the axis to direct the paint particles toward a confluence on the axis, and means for controlling the air flow from the plenum including a first air input means for admitting air to impart a forward flow direction to the sheath of air and a second air input means for admitting air to impart a tangential flow direction to the sheath of air, whereby the sheath air velocity is controlled to determine the paint spray pattern from the head.

4. A paint spray apparatus having a rotary head defining an axis and a forward rim for the centrifugal atomization and dispersion of paint particles in a circular pattern, a vortex plenum surrounding the head and having an annular discharge slit to the rear of the rim for projecting a concial sheath of air around and adjacent the rim to intersect the circular pattern of paint, the sheath of air having a velocity component toward the axis sufficient to direct the paint particles toward a confluence on the axis, and means for controlling the air flow from the plenum including a first air input means for admitting air to impart a forward flow direction to the sheath of air, the effect of the forward flow direction being to impart a forward velocity to the paint spray pattern from the head and a second air input means for admitting air to impart a tangential flow direction to the sheath of air, the effect of the tangential flow being to impart a swirl to the sheath and to enlarge the spray pattern, whereby the sheath air velocity is controlled to determine the paint spray pattern from the head.

5. A paint spray apparatus having a rotary head defining an axis and a forward rim for the centrifugal dispersion of paint, a vortex plenum surrounding the head and having an annular discharge slit to the rear of the rim for projecting a conical sheath of air around and adjacent the rim to direct the paint toward a confluence on the axis, and means for variably controlling the amount of swirl in the air flow from the plenum including a first air input means for admitting air to impart a forward flow direction to the sheath of air, a second air input means for for admitting air to impart a tangential flow direction to the sheath of air, and means for controlling the volume of air admitted through each input means, whereby the sheath air velocity is variably controlled to adjust the paint spray pattern from the head.

6. A paint spray apparatus having a rotary head defining an axis and a forward rim for the centrifugal dispersion of paint, a vortex plenum surrounding the head comprising a base, and inner and outer annular walls widely spaced at the base and converging forwardly from the base and terminating in exit wall regions angularly disposed to the axis and forming an annular discharge slit to the rear of the rim for projecting a conical sheath of air around and adjacent the rim to direct the paint in a forward direction toward a confluence on the axis, and means for controlling the plenum air flow including a first air input means comprising axially disposed ports in the base for admitting air in a direction to impart a forward flow to the sheath of air and a second air input means comprising tangentially disposed ports in the base for admitting air in a direction to impart a tangential flow component to the sheath of air, whereby the sheath air velocity is controlled to determine the paint spray pattern from the head.

7. An apparatus for spraying liquid coating material onto a workpiece comprising;

means for centrifugally dispersing coating material into the air in an annular pattern about an axis, and means for directing a conical sheath of air transverse to the pattern in a direction generally toward the workpiece and toward a confluence on the axis with sufficient velocity to effect turbulent mixing of coating material particles, whereby the coating material is atomized and deposited on the workpiece in a circular film of substantially uniform thickness.

8. An apparatus for spraying liquid coating material onto a workpiece comprising;

means for centrifugally dispersing coating material into the air in an unatomized form in an annular pattern about an axis, and means for directing a conical sheath of air transverse to the pattern in a direction generally toward the workpiece and toward a confluence on the axis with sufficient velocity to atomize the coating material and to effect turbulent mixing of coating material particles at the confluence, whereby the coating material is atomized and deposited on the workpiece in a circular film of substantially uniform thickness.

9. An apparatus for spraying liquid coating material onto a workpiece comprising;

means for centrifugally dispersing coating material into the air in an annular pattern about an axis.

means for directing a conical sheath of air transverse to the pattern in a direction generally toward the workpiece and toward a confluence on the axis with sufficient velocity to effect turbulent mixing of coating material particles, and means for imparting a swirl moment to the sheath of air to effect enlargement of the spray pattern emerging from the confluence, whereby the coating material is atomized and deposited on the workpiece in a circular film of substantially uniform thickness and a diameter dependent on the swirl moment of the sheath.

10. An apparatus for spraying for spraying liquid coating material onto a workpiece comprising;

means for centrifugally dispersing coating material into the air in an unatomized form in an annular pattern about an axis, means for directing a conical sheath of air transverse to the pattern in a direction generally toward the workpiece and toward a confluence on the axis and having a velocity component toward the confluence and a swirl component, with sufficient resultant velocity to effect turbulent mixing of coating material particles, and means for controlling the air velocity compoment in the direction of the confluence to a value sufficient to atomize the coating material and to impart forward velocity to the particles, whereby the coating material is atomized and deposited on the workpiece in a circular film of substantially uniform thickness.

11. A method of spraying liquid coating material onto a workpiece comprising the steps of;

centrifugally dispersing coating material into the air in an annular pattern about an axis, and directing a conical sheath of air transverse to the pattern in a direction generally toward the workpiece and toward a confluence on the axis with sufficient velocity to effect turbulent mixing of coating material particles, whereby the coating material is atomized and deposited on the workpiece in a circular film of substantially uniform thickness.

12. A method of spraying liquid coating material onto a workpiece comprising the steps of;

centrifugally dispersing coating material into the air in an atomized form in an annular pattern about an axis, and directing a conical sheath of air transverse to the pattern in a direction generally toward the workpiece and toward a confluence on the axis with sufficient velocity to atomize the coating material and to effect turbulent mixing of coating material particles at the confluence, whereby the coating material is atomized and deposited on the workpiece in a circular film of substantially uniform thickness.

13. A method of spraying liquid coating material onto a workpiece comprising the steps of;

centrifugally dispersing coating material into the air in an annular pattern about an axis, directing a conical sheath of air transverse to the pattern in a direction generally toward the workpiece and toward a confluence on the axis with sufficient velocity to effect turbulent mixing of coating material particles, and imparting a swirl moment to the sheath of air to effect enlargement of the spray pattern emerging from the confluence, whereby the coating material is atomized and deposited on the workpiece in a circular film of substantially uniform thickness and a diameter dependent on the swirl moment of the sheath.

14. A method of spraying liquid coating material onto a workpiece comprising the steps of;

centrifugally dispersing coating material into the air in an unatomized form in an annular pattern about an axis, directing a conical sheath of air transverse to the pattern in a direction generally toward the workpiece and toward a confluence on the axis and having a velocity component toward the confluence and a swirl component, with sufficient resultant velocity to effect turbulent mixing of coating material particles, and controlling the air velocity component in the direction of the confluence to a value sufficient to atomize the coating material and to impart forward velocity to the particles, whereby the coating material is atomized and deposited on the workpiece in a circular film of substantially uniform thickness.

* * * * *